US010889139B2

(12) United States Patent
Prett et al.

(10) Patent No.: US 10,889,139 B2
(45) Date of Patent: Jan. 12, 2021

(54) SECURITY DOCUMENT WITH ATTACHED SECURITY DEVICE WHICH DEMONSTRATES INCREASED HARVESTING RESISTANCE

(71) Applicant: Crane & Co., Inc., Boston, MA (US)

(72) Inventors: Giles D. Prett, Dalton, MA (US); Kraig M. Brigham, Lenox, MA (US); Manish Jain, Pittsfield, MA (US)

(73) Assignee: Crane & Co., Inc., Boston, MA (US)

( * ) Notice: Subject to any disclaimer, the term of this patent is extended or adjusted under 35 U.S.C. 154(b) by 0 days.

(21) Appl. No.: 16/503,273

(22) Filed: Jul. 3, 2019

(65) Prior Publication Data

US 2020/0009894 A1 Jan. 9, 2020

Related U.S. Application Data

(60) Provisional application No. 62/693,661, filed on Jul. 3, 2018.

(51) Int. Cl.

| | |
|---|---|
| ***B42D 25/346*** | (2014.01) |
| ***B42D 25/324*** | (2014.01) |
| ***B42D 25/36*** | (2014.01) |
| ***G07D 7/164*** | (2016.01) |
| ***G07D 7/0047*** | (2016.01) |
| ***B42D 25/29*** | (2014.01) |

(52) U.S. Cl.

CPC ..... *B42D 25/346* (2014.10); *B42D 25/29* (2014.10); *B42D 25/324* (2014.10); *B42D 25/36* (2014.10); *G07D 7/0047* (2017.05); *G07D 7/164* (2013.01)

(58) Field of Classification Search

CPC ..... B42D 25/346; B42D 25/324

See application file for complete search history.

(56) References Cited

U.S. PATENT DOCUMENTS

| | | | | |
|---|---|---|---|---|
| 2011/0019283 | A1 | 1/2011 | Steenblik et al. | |
| 2014/0238628 | A1* | 8/2014 | Seidler | B42D 25/47 162/116 |
| 2016/0101643 | A1 | 4/2016 | Cape et al. | |
| 2016/0127649 | A1 | 5/2016 | Tsuchiya | |
| 2017/0253069 | A1 | 9/2017 | Kerkar et al. | |

FOREIGN PATENT DOCUMENTS

| | | | | |
|---|---|---|---|---|
| DE | 102017113787 | A1 * | 12/2018 | B42D 25/346 |
| DE | 102017118579 | A1 * | 2/2019 | B42D 25/346 |
| EP | 1997643 | A2 * | 12/2008 | B42D 25/346 |
| WO | WO-2011161114 | A1 * | 12/2011 | B42D 25/346 |

(Continued)

OTHER PUBLICATIONS

EP 1997643 English Translation (Year: 2008).*

(Continued)

*Primary Examiner* — Kyle R Grabowski

(57) ABSTRACT

A security document has a security substrate, a security device and a structural weakness element, wherein the security device is coupled to the security substrate, wherein the structural weakness element is integrated with at least one of the security substrate or the security device, the structural weakness element defining an anti-harvesting area and a bulk area, and wherein the anti-harvesting area has one or more of structural fidelity or optical fidelity with the bulk area.

17 Claims, 3 Drawing Sheets

(56) References Cited

FOREIGN PATENT DOCUMENTS

| | | | | |
|---|---|---|---|---|
| WO | WO-2013156149 A1 * | 10/2013 | ..... | B42D 25/346 |
| WO | WO-2016016126 A1 * | 2/2016 | ..... | B42D 25/346 |

OTHER PUBLICATIONS

DE 10/2017/113787 English Translation (Year: 2018).*
WO 2013/156149 English Translation (Year: 2013).*
ISA/US, International Search Report and Written Opinion of the International Searching Authority, Application No. PCT/US2019/040634, dated Sep. 13, 2019, 9 pages.

* cited by examiner

SECURITY DOCUMENT WITH ATTACHED SECURITY DEVICE WHICH DEMONSTRATES INCREASED HARVESTING RESISTANCE

CROSS-REFERENCE TO RELATED APPLICATION(S) AND CLAIM OF PRIORITY

This application claims priority under 35 U.S.C. § 119(e) to U.S. Provisional Patent Application No. 62/693,661, filed Jul. 3, 2018, the disclosure of which is incorporated herein by reference.

TECHNICAL FIELD

The present disclosure generally relates to a security document having a security device coupled to a security substrate and having a structural weakness element incorporated therein.

BACKGROUND

Security documents may be rendered less susceptible to forgery or counterfeiting by incorporating security devices, which have various security features and are provided in various forms, in the security document. The security or integrity of a document or instrument will, all other things being equal, generally increase with the complexity and number of separate and distinct security features that it contains.

Counterfeiters often rely on the sophistication of contemporary printing and copying technologies to copy legitimate security documents. In recent years, anti-counterfeit security devices, in particular, security threads and patches having optically variable security features, have gained increased use as authenticating features for securing security documents. Optically variable security features provide a different visible appearance to the viewer from different viewing angles. As such, even the most advanced printing and copying technologies are not able to mimic the optical variability provided by the optically variable features.

By way of example, U.S. Pat. No. 7,333,268 to Steenblik et al. depicts a micro-optic film material that generally comprises (a) an arrangement of micro-sized image icons located on or within a polymeric substrate, and (b) an arrangement of focusing elements (e.g., microlenses). The image icon and focusing element arrangements are configured such that when the arrangement of image icons is viewed through the arrangement of focusing elements, one or more synthetic images are projected. These synthetic images may demonstrate optical variability as they show a number of different optical effects (e.g., change in color, size, shape, number, etc.) when viewed from various points of view. Material constructions capable of presenting such effects are also described in U.S. Pat. No. 7,468,842 to Steenblik et al., U.S. Pat. No. 7,738,175 to Steenblik et al., U.S. Pat. No. 7,830,627 to Commander et al., U.S. Pat. No. 8,149,511 to Kaule et al., U.S. Pat. No. 8,878,844 to Kaule et al., U.S. Pat. No. 8,786,521 to Kaule et al., European Patent No. 2162294 to Kaule et al., and European Patent No. 2164713 to Kaule.

International Patent Application No. PCT/GB2005/001618 to Commander et al. describes a security device that comprises a substrate having an array of microlenses on one side and one or more corresponding arrays of microimages on the other side. The distance between the microlens array and the microimage array(s) is substantially equal to the focal length of the microlenses. The substrate is sufficiently transparent to enable light to pass through the microlenses so as to reach the microimages. Each microimage is defined by an anti-reflection structure (e.g., a moth-eye structure) on the substrate, which is formed by a periodic array of identical structural elements and an at least partially reflecting layer. Microimages are formed by one or both of the anti-reflection structure and the at least partially reflecting layer. Light passing through the substrate and impinging on the microimages is reflected to a different extent than light which does not impinge on the microimages, thereby rendering the microimages visible.

For banknotes and other security documents, these security threads and patches are either partially embedded within the banknote or document, or applied to a surface thereof. For passports or other identification (ID) documents, these materials could be used as a full laminate.

Due in part to the general effectiveness of security devices, such as described above, in preventing counterfeits based on reproduction of the security devices, counterfeiters have had to resort to much more other techniques for producing counterfeit security documents. One such technique is harvesting. The term "harvesting", in the context of the present disclosure, encompasses removing, or decoupling the security device from the security substrate of the security document intact whether for the purposes of counterfeiting, forgery or substitution. Harvesting is a counterfeiting method when traditional counterfeiting (e.g., photocopying or other methods of duplication) are technically impossible or otherwise not an option.

SUMMARY

Surprisingly, the inventors of the present disclosure have found that improvements in the anti-harvesting properties of a security device (SD) can be achieved by integrating a structural weakness element (SWE) into the security document such that the security device comprises an anti-harvesting area and a bulk area. According to some embodiments, the anti-harvesting area causes the security device to be structurally and visibly altered when there is an attempt to harvest the security device from the security document. In some embodiments, the anti-harvesting area prevents the all or part of the security device from being removed intact from the security document. According to certain embodiments, the structural weakness element is integrated as part of the security document in such a way that the anti-harvesting area exhibits structural fidelity or optical fidelity with the bulk area of the security document.

Embodiments according to the present disclosure include (i) a security document, (ii) a method of making the security document, (iii) a product-by-process where the product is a security document made by the process defined by the method of aspect (ii) and (iv) use of the structural weakness element.

In a first embodiment, a security document comprises a security device (SD) coupled to a security substrate, and a structural weakness element (SWE) is integrated with the security substrate, the security device or both to define an anti-harvesting area and a bulk area within the security device. The anti-harvesting area has at least one of structural fidelity or optical fidelity with the bulk area. The security device, and by extension, the security document into which it is incorporated, is provided with increased harvesting resistance relative to conventional security documents (e.g., banknotes having micro-optic security devices as described in U.S. Pat. No. 7,333,268 to Steenblik et al., but without at least the structural weakness element).

In a second embodiment, a method of making the security document comprises supplying a security document having an attached (e.g., coupled) security device; and integrating the security device or security substrate with a structural weakness element. The structural weakness element is configured to cause the security device or security document to fail when an attempt is made to detach the security device from the security substrate.

In a third embodiment, a security document comprises a security device (SD) that is coupled to a security substrate; and a structural weakness element (SWE) that is integrated with the security substrate, the security device or both to define an anti-harvesting area and a bulk area within the security device. The security document is formed by supplying a security document having an attached (e.g., coupled) security device; and integrating the security device or security substrate with a structural weakness element.

In a fourth embodiment, the use of the structural weakness element to provide increased anti-harvesting resistance comprises providing a security document as described herein where the security document comprises a security substrate coupled to a security device, and a structural weakness element integrated with the security substrate or security device to define an anti-harvesting area and a bulk area such that the anti-harvesting area has at least one of structural fidelity or optical fidelity with the bulk area.

Embodiments according to the present disclosure seek to provide apparatus and methods which deter harvesting of a security device. More importantly, it is a purpose of certain embodiments according to present disclosure to provide a security document that demonstrates improved harvesting resistance without impacting the counterfeit resistance provided by the security device incorporated therein. For example, it has been surprisingly found that by incorporating a structural weakness element as part of the security document, the harvesting resistance is improved, and in some embodiments, the harvesting resistance is improved without impacting the counterfeit resistance provided by the optically variable feature found in certain threads, patches, etc. Surprisingly, in certain embodiments incorporating the structural weakness element after the security device has been securely coupled to the security substrate, at least one of the optical fidelity and the structural fidelity between the anti-harvesting area and the bulk area of the security device is provided. The term "optical fidelity," as used herein, encompasses the security device providing an optically variable image in the anti-harvesting area which is at least substantially similar to the optically variable image found in the bulk area. This may be particularly advantageous in the context of the synthetic image(s) provided by micro-optic security devices (e.g., threads) such as those provided in U.S. Pat. No. 7,333,268 to Steenblik et al. According to various embodiments, certain micro-optic security devices (such as stripes or patches) are particularly suitable for combination with structural weakness elements as disclosed herein, because such security devices include an array of focusing elements through which the structural weakness elements can be formed so that they complement the synthetic image without destroying the underlying image icons (i.e., image elements). The term "structural fidelity," as used herein, encompasses the property wherein the security thread in the anti-harvesting area is not deformed relative to the shape of the thread in the bulk area. Alternatively, where structural weakness elements are integrated in the anti-harvesting area, these elements are not deformed in any significant way. Applicant has surprisingly found that this may be advantageous in the context of products utilizing to the security devices (e.g., threads: stripes, patches, etc.), such as provided in U.S. Pat. No. 7,333,268 to Steenblik et al. Such security devices, which a polymeric base material construction, can be susceptible to physical deformations in the anti-harvesting area due to the stretching or tension variability applied to the security device during coupling to the security substrate. For instance, tension adjustments may cause the security device to stretch and will cause permanent or evident deformations in the anti-harvesting areas that are distinct from the bulk area. For example, stretching of the substrate can cause the width of the thread to narrow faster in the anti-harvesting area Alternatively, stretching the substrate can cause the structural weakness elements to deform the optically variable effects faster in the area around the security device, than in the bulk area. Thus, depending on how a security device is integrated with a bulk area of the substrate, tensile stress on the substrate can destroy the structural fidelity between the two areas by, for example, causing a tapering in the anti-harvesting area not reflected in the bulk area. However, by first coupling the security device to the security substrate, as described with reference to certain embodiments according to this disclosure, that the security device can be anchored to the security substrate such that the structural weakness element does not impact the structural fidelity of the security device during the coupling phase, since the security device will already have been coupled to the security substrate done. As such, the structural weakness element does not cause the security device, in the anti-harvesting area, to lose structural or optical fidelity with the bulk area; rather the security document, with its security device coupled to its security substrate is not tapered or otherwise deformed.

In certain embodiments according to this disclosure, the structural weakness element comprises a set of perforations formed in the security device, the security substrate, another component layer of the security document or any combination thereof. As used herein, the term "set" encompasses one or more items of a specified type. In certain embodiments, the set of perforations are arranged to define the anti-harvesting area distinct from the bulk area of the security device. In embodiments comprising multiple perforations, the perforations may be arranged randomly or in a pattern, and define the bulk and anti-harvesting areas.

In certain embodiments according to this disclosure, the security document is a banknote comprising a security substrate, a security device and a structural weakness element. The security device is, in some embodiments, a thread (i.e., patch or stripe) coupled (i.e., affixed to the surface, embedded or partially embedded) to the security substrate and the structural weakness element is a set of perforations integrated with at least one of the security substrate and the security device to define an anti-harvesting area and a bulk area in the security device having structural and optical fidelity to each other.

Additional advantages and embodiments of the present disclosure will become readily apparent to persons having ordinary skills in the art (PHOSITA) in view of the following detailed description. As will become evident, the non-limiting examples described herein can be modified, with such modified embodiments falling within the scope of the present disclosure. The present disclosure may be practiced without some or all of these specific details. In other instances, well known process operations have not been described in detail, in order to avoid unnecessarily obscuring the present disclosure. Accordingly, the drawings and description are to be regarded as illustrative in nature, and not as restrictive.

Other technical features may be readily apparent to one skilled in the art from the following figures, descriptions, and claims.

Before undertaking the DETAILED DESCRIPTION below, it may be advantageous to set forth definitions of certain words and phrases used throughout this patent document. The term "couple" and its derivatives refer to any direct or indirect communication between two or more elements, whether or not those elements are in physical contact with one another. The terms "include" and "comprise," as well as derivatives thereof, mean inclusion without limitation. The term "or" is inclusive, meaning and/or. The phrase "associated with," as well as derivatives thereof, means to include, be included within, interconnect with, contain, be contained within, connect to or with, couple to or with, be communicable with, cooperate with, interleave, juxtapose, be proximate to, be bound to or with, have, have a property of, have a relationship to or with, or the like. The phrase "at least one of," when used with a list of items, means that different combinations of one or more of the listed items may be used, and only one item in the list may be needed. For example, "at least one of: A, B, and C" includes any of the following combinations: A, B, C, A and B, A and C, B and C, and A and B and C.

Definitions for other certain words and phrases are provided throughout this patent document. Those of ordinary skill in the art should understand that in many if not most instances, such definitions apply to prior as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

Figure 1A:
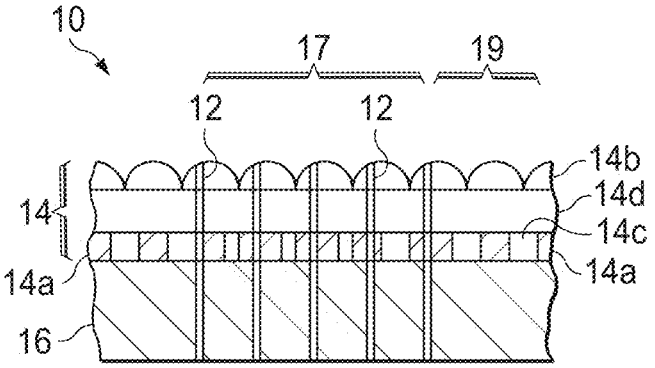
FIG. 1A illustrates an example of a security document according to some embodiments of this disclosure wherein a set of perforations extend at a normal angle through the entire thickness of both a micro-optic security device and an underlying security document.

Certain embodiments according to this disclosure relate to a security document providing improved harvesting resistance, without any concomitant degradation of the counterfeit resistance provided by the security device. In some embodiments, the security document comprises a structural weakness element that is integrated into at least one other component of the security document such that when an attempt is made to harvest the security device, the security device or the security substrate of the security fails. Surprisingly, yet advantageously, in certain embodiments, the structural weakness element can be integrated after the security device has been coupled to the security substrate, without damaging the security device or the security substrate. While it is contemplated that the structural weakness element can be applied to the security device before it is applied to the security substrate, Applicant has found that under such circumstances, the security device can become deformed during coupling to the security substrate. Such deformation can disrupt the structural or optical fidelity between the anti-harvesting area of the security device and the bulk area of the security device. In various embodiments according to the present disclosure, the security device is first coupled to the security substrate, then the structural weakness element is integrated into at least one of the security device and the security substrate. As such, in some embodiments, the resulting security document includes a security device that has at least one of structural fidelity between the anti-harvesting area and the bulk area or optical fidelity between the anti-harvesting area and the bulk area.

As already noted herein, embodiments according to this disclosure include (i) a security document, (ii) a method of making the security document, (iii) a product-by-process where the product is a security document made by the process defined by the method of (ii) and (iv) use of the structural weakness element, and more broadly, the security documents of (i) and (iii), to provide anti-harvesting properties to a security document.

Security Substrate

Various suitable security substrates will become apparent to persons having ordinary skill in the art in view of the present disclosure. Those embodiments should be understood as forming alternative embodiments to those described herein and are therefore within the scope of the present disclosure. For example, contemplated within the scope of the present disclosure are substrates containing paper or other fibrous materials, such as cellulose, paper-containing materials, composite materials, paper-polymer hybrids and combinations thereof. Examples of composite materials include, without limitation, multilayer structures or laminates of paper and at least one plastic or polymeric material. In some embodiments, the security substrate is a fibrous paper substrate.

Security Device

Security documents according to certain embodiments of this disclosure comprise a security device that is coupled to a security substrate. In hindsight view of the present disclosure, various embodiments of the present disclosure, including various suitable security devices, will become apparent to persons having ordinary skills in the art. As such, the specific security devices described herein are only exemplary. For example, while micro-optic security devices are described herein, other security devices including those with and without optically variable features are also contemplated within the scope of the present disclosure.

Examples of security devices suitable for use in certain embodiments according to this disclosure are described, without limitation, in U.S. Pat. No. 9,873,281 to Cape et al. These single-layered systems are made up of an arrangement of optionally reflective arcuate elements having an upper arcuate surface, a lower surface, and an arcuate area bounded by the upper arcuate and lower surfaces, and an optionally reflective pattern of image relief microstructures disposed on or within at least some of the optionally reflective arcuate elements. The arrangement of optionally reflective arcuate elements and the optionally reflective pattern of image relief microstructures are in a single layer and interact to project one or more images.

The microstructures in certain single layered security devices can extend from an upper arcuate surface to a lower surface, or instead can start or terminate at points between these surfaces. In regard to the latter category of microstructures, for an upper arcuate surface with convex surface curvature, the image relief microstructures extend downwardly from this surface, terminating within the arcuate area, and for an upper arcuate surface with concave surface curvature, the image relief microstructures extend upwardly from this surface, terminating within an area defined by the curvature of the upper arcuate surface. Transmission of light through the system, reflection of light from the system or a combination thereof forms one or more images.

Examples of multi-layered security devices which can be used in embodiments according to this disclosure are described in, without limitation, International Patent Application Publications WO2005/052650, WO2006/125224, WO2008/008635, WO2011/019912, WO2011/163298, WO/2013/028534, WO2014/143980, WO2009/017824, WO2016/044372, WO2016/011249, WO2013/163287, WO2007/133613, WO2012/103441, and WO2015/148878, WO2005/106601, WO2006/087138, which are all hereby incorporated herein in their entirety. Such security devices can comprise one or more arrangements of image elements (i.e., image icons) on or within a surface of a substrate, and one or more arrangements of focusing elements (e.g., microlenses) disposed substantially parallel to the arrangement(s) of image elements and at a distance from the image elements sufficient for the microlenses to project one or more synthetically magnified images of the image elements in the image icons. Groups of associated focusing elements (e.g., microlenses) and image elements (e.g., icon structures) which may or may not repeat across the length or width of the image security device, collectively form, magnify and project the synthetic images (i.e., optically variable feature). By way of example, microlens/icon structures project one or more synthetically magnified images as the system is tilted, or as the viewing angle changes.

The micro-optic security device described herein, in some embodiments, comprises a device substrate that is light-transmitting. In one embodiment, such a device substrate is a light-transmitting polymer film. In such a micro-optic security device, the light-transmitting polymer film functions as an optical spacer. A light-transmitting polymer film according to certain embodiments may be formed from one or more essentially colorless polymers such as polyester, polyethylene, polyethylene terephthalate, polypropylene, polyvinyl carbonate, polyvinylidene chloride, and combinations thereof.

According to various embodiments, thickness of the light-transmitting polymer film ranges from about 12 to about 26 microns (in some embodiments, from about 13 to about 17 microns). Suitable focusing elements include, without limitation, microlenses such as (i) one or more arrangements of cylindrical or non-cylindrical lenses; (ii) one or more arrangements of focusing reflectors; (iii) one or more opaque layers containing a plurality of apertures; and (iv) one or more reflective layers.

Focusing elements according to various embodiments of this disclosure can be non-cylindrical lenses; particularly those having a spherical or aspherical surface. Aspheric surfaces include conical, elliptical, parabolic and other profiles. These lenses may have circular, oval, or polygonal base geometries, and may be arranged in regular or random, one- or two-dimensional arrays. In certain embodiments, the microlenses are aspheric lenses having polygonal (e.g., hexagonal) base geometries that are arranged in a regular, two-dimensional array on the substrate or light-transmitting polymer film.

Microlens focusing elements according to various embodiments of this disclosure have a width and base diameter of less than about 50 microns. In certain embodiments, widths of than about 45 microns or between about 10 and about 45 microns may be advantageous. In various embodiments, the focal lengths for these focusing elements are less than about 50 microns, with focal lengths of less than about 45 microns or between about 10 and about 30 microns being particularly advantageous in some embodiments. Focusing elements according to certain embodiments of this disclosure have an f-number that is less than or equal to 2, with f-numbers of less than or equal to 1 being advantageous in certain embodiments.

The image elements (i.e., icons) according to various embodiments of this disclosure, comprise one or more icon designs. Moreover, the image elements may comprise one or more slices (i.e., narrow bands or strips) from one or more image element designs, wherein each slice is paced slightly apart from, abuts (i.e., touches or joins at an edge or border), or slightly overlaps an adjacent slice(s). The slices may be manipulated in terms of content, spacing or degree of overlap to adjust or fine-tune the final projected image(s).

The icon designs used to prepare the first type of image icons (i.e., intact image icons made up of one or more icon designs) or the second type (i.e., so-called stitched icons)

may be of any type of fixed or fluid graphic design including, but not limited to, positive or negative symbols, shapes, letters, numerals, text, and combinations thereof. Examples of fixed icon designs include a star, a box, a bell, a bell in combination with a number, etc., while examples of fluid icon designs include a blinking eye and a shrinking or rotating currency symbol.

To form a stitched icon, the icon designs that will make up the stitched icon are decomposed into bands or strips. The bands or strips from each icon design may then be arranged in alternating or interleaved fashion with the slices spaced apart, abutting, or slightly overlapping, to form the stitched icons. Each slice within a stitched icon is aligned behind one or more lenses at its/their focal point(s). In certain embodiments according to this disclosure, computer programs are used to prepare these slices. U.S. Pat. No. 8,739,711 to Cote, provides a non-limiting selection of examples of stitched icons suitable for use in embodiments according to this disclosure.

It should be understood that while certain embodiments according to this disclosure are primarily described in the context of security devices with optically variable features, the scope of this disclosure is not so limited and should be understood as being applicable where the security device does not include an optically variable feature or uses a combination of static features and optically variable features. Moreover, the security device may take various forms such as a single- or multi-layer film material employing metal, metalized, selectively demetalized fluorescence and magnetic elements, color shift, holographic, 3D effects, gratings, and combinations thereof.

Coupling

Certain embodiments according to this disclosure comprise a security document comprising a security device coupled to a security substrate. It is to be understood herein, that while in some embodiments, the security device is coupled directly to the security substrate, it is also contemplated herein that the security device is indirectly coupled to the security substrate. Accordingly, references to coupling of the security device to the security substrate should be understood and read in this context. For example, in one embodiment, the security device is coupled, by means of an adhesive directly to a surface of the security substrate. In an alternative embodiment, the security device is coupled to an interleaved component—such as a tie layer, masking layer, reflective layer, ink layer, or other machine detectable (e.g., IR, fluorescence, etc.) material layer—which is in turn coupled directly or indirectly to the security substrate. Moreover, coupling of the security device to the security substrate, whether directly or indirectly, may be on a top surface or a bottom surface of the security substrate or embedded therein. It is also contemplated herein that, in some embodiments, the security device is in the form of a strip or a patch. In the case where the security device is a strip/stripe, it is contemplated that the strip could be surface applied, embedded or interweaved into the paper. Where the security device is surface applied, a full surface of the security device is exposed while for an interweaved security device, a portion of one surface of the security device is hidden beneath a portion the security substrate. For example, the interweaved security device forms windows in which the security device is accessible/visible and forming bridges under which the security device is inaccessible/hidden. Where the security device is embedded, it can be buried beneath within the security substrate and in one embodiment is visually detectable through transmitted light.

Additional methods for coupling the security device, either directly or indirectly, such as may be apparent to a skilled artisan are within the contemplated scope of this disclosure. For example, an adhesive that is activated by heat, water, or radiation is most suitable. Alternatively, the security device may be directly coupled to the security substrate during or after the formation of the security substrate. For example, in one illustrative embodiment, the security device is coupled to the security substrate, by being interwoven into a fibrous slurry used to form the security substrate, and is interwoven with this slurry during the paper manufacturing process. It is further contemplated that, in some embodiments, a pressure, heat, water or other radiation activated adhesive is applied between the security device and the security substrate in order to couple the two components of the security document. In some embodiments, use of a heat or water activated adhesive can be advantageous.

As noted herein, in certain embodiments, the security device may be a thread (i.e., patch or stripe). Coupling of the security device to the security substrate during the manufacturing process of the security substrate often requires in-process adjustments of the tension on the security device during manufacture. As part of such in-process adjustments, the security device is stretched, compressed or released. Such in-process adjustment causes the security device to deform by causing at least one of optical failure or structural failure, wherein the anti-harvesting area of the security device, can lose at least one of its optical fidelity or structural fidelity with the bulk areas of the security device. Where the security device is a stripe, the present disclosure is most suitable since in coupling the security device to the security substrate, the maximum stretching (tension variation) of the security device occurs.

According to various embodiments, when a single or multi-layer micro-optic security device provided as a security thread, it may be interwoven (i.e., partially embedded) in a banknote, visible only in clearly defined windows and hidden in certain sections on the banknote's surface. These windows, which, in certain embodiments, measure from about 6 to about 21 millimeters (mm) in length and from about 3.5 to about 4.5 mm in width, allow for imaging groups ranging in number from about ½ to about 5 to be physically present in any one such window. The security device may be designed so that the imaging groups in each window project images having the same or different optical effects. To further increase the counterfeit resistance of the banknote, the security device may be coupled to the security substrate such that these projected images may be coordinated with printed images on the security device or the security substrate.

According to various embodiments, when a single or multi-layer micro-optic security device is in the form of a patch, it may be applied to a surface of a banknote with an adhesive. In one contemplated embodiment, an adhesive layer having a thickness ranging from about 3 to about 12 microns is applied to a surface of the patch. Suitable adhesives are not limited and include, but are not limited to, thermoplastic adhesive systems including acrylics (e.g., poly(methyl methacrylate)) and polyurethanes, and thermally activated adhesives (i.e., hot melt or heat seal adhesives).

Structural Weakness Element

As discussed elsewhere in this disclosure, harvesting is a viable mechanism for creating counterfeit, or inauthentic security documents, and as such, resisting harvesting remains a source of technical challenges and opportunities for improvement in the performance of security devices and security documents. Moreover, it is also desirable that the security document can be integrated with this anti-harvesting property without damaging or destroying the anti-counterfeiting properties of the security device. It is also desirable that the anti-harvesting property can be integrated into the security document without impacting the coupling of the security device to the security substrate of the security document. It is therefore the objective of the embodiments according to the present disclosure to provide a security device which speaks to users' concerns regarding harvesting resistance. The term "structural weakness," as used in this disclosure, encompasses a portion of the security device or security document that includes applied defects which induce structural or optical failure within the security device, and cause the device to become inoperative (for example, by ceasing to provide the optical variability providing indicia of authenticity) in response to attempts to harvest the security device from the security document.

In certain embodiments according to this disclosure, by forming points of weakness (anti-harvesting areas) in the security device or security substrate, the harvesting resistance of the security device/document is improved without negatively impacting the counterfeit resistance of the security device/document. The structural weakness element provides the security document or security device with increased harvesting resistance. In certain embodiments, the structural weakness element causes the device or document to fail (i.e., tear, fracture, deform or separate) when an attempt is made to detach (e.g., forcibly remove) the security device from the security document. In select embodiments, the structural weakness element prevents the separation (i.e., de-coupling) of the security device from the security substrate without permanently or visibly altering or destroying the security device, security substrate or security document. For example, in certain embodiments, the structural weakness element prevents the security device from being decoupled as a single, re-useable piece, thereby preventing its harvesting and re-use on a counterfeit security document. In particular embodiments, the present disclosure is suitable for securing and authenticating security documents, such as identification documents (e.g., passports, government IDs, etc.), currency documents (e.g., checks, banknotes, etc.), or consumer product documents (e.g., labels, signs, tags, etc.).

In certain embodiments according to this disclosure, even though a structural weakness element has been added to the device, the optical variability of the security device, for example, remains intact and functional thereby maintaining its ability to thwart counterfeiting efforts that rely, for example, on advanced printing/copying technologies. However, because the structural weakness elements are, in some embodiments, strategically integrated into at least one structural element of the security document, attempts to harvest the security device cause the security device to observably deform. Such observable deformations make the security device appear compromised, and thus unsuitable for use in counterfeit documents in which the security device of the counterfeit document is to have the visual indicia of authenticity provided by the security device. These observable deformations may be more easily understood as structural or optical failures in the security device. As used herein, the term "structural failure" encompasses tearing, lacerating, breaking, crumpling, or disintegration of at least a portion of the security device, which prevent the security device from being transferred intact from an authentic document to a counterfeit one. As used herein, the term "optical failure" encompasses visible degradation of the optically variable feature of the security device. Examples of optical failure include, without limitation, rendering a dynamic (e.g., moving) optical variable feature static, rendering the optically variable feature invisible, or reducing a quality (for example, the clarity) of the optically variable feature.

It is contemplated herein that, according to certain embodiments of this disclosure, the structural weakness element may be integrated in any layer or component of the security document. In certain embodiments, it can be advantageous to integrate the structural weakness element with the security substrate or the security device. This is because, in some embodiments, at least one of the security device and the security substrate are often disposed at the surface(s) of the security document and are therefore the points of attack by a would-be counterfeiter/harvester. Integration of the structural weakness element with the security substrate can improve harvesting resistance by causing the substrate to fail (i.e., break apart or fracture) during harvesting. Additionally, integrating the structural weakness element with the security substrate, can increase the difficulty in separating the security device from areas in the security substrate having structural weakness elements. Alternatively, in some embodiments, the structural weakness element is integrated with at least the security device. Particularly, strategic integration of the structural weakness element into the security device creates failure points/areas within the security device, such that it is increasingly difficult, if not impossible, to harvest the security device without observably deforming the security device, resulting in either structural or optical failure. Persons having ordinary skills in the art will appreciate that some security documents include windowed security devices where the security device is weaved into the security substrate during manufacture of the security substrate forming windowed areas and bridges. In such instances, it has been found advantageous to include the structural weakness element across the bridge, thereby creating a structural obstacle to efforts to harvest security device portions buried underneath the bridges, which will be observably deformed when equipped with the structural weakness element.

The structural weakness elements are, in some embodiments, strategically integrated such that they are configured (e.g., sized, shaped, numbered, distributed or arranged) in a manner that facilitates at least one of structural or optical failure during a harvesting attempt. In some embodiments, the structural weakness element comprises a set of perforations. As used herein, the term "perforation" or "perforations" encompasses holes extending through at least a portion of the depth/thickness of a particular component of the security document or a combination of components.

Perforations according to some embodiments of this disclosure may take various shapes and sizes and may be arranged in various patterns or randomly distributed in the anti-harvesting area. In certain embodiments, the perforations are arranged to define an anti-harvesting area distinct from the remaining bulk area. As used herein, the term "anti-harvesting area" encompasses area in, below or above the security device where a set of perforations are arranged, such as in the security substrate, the security device, or any other component of the security document. In other words, in some embodiments, the anti-harvesting area comprises the location(s) where the arrangement of the set(s) of perforations overlap with the security device. The perforations are, in certain embodiments, arranged such that a border region is formed between the bulk area and the anti-harvesting area. In some embodiments, it can be advantageous to arrange perforations in a predetermined pattern. Surprisingly, embodiments in which perforations have been arranged in a pattern tapering from either edge of the security device toward the center or from one side towards the opposing side have proven effective in facilitating structural or optical failure in response to harvesting attempts.

The perforations contemplated within the scope of the present disclosure may take on a uniform size, shape, or depth across the anti-harvesting area or they may so vary across the anti-harvesting area. In certain embodiments, it can be advantageous that the perforations be wide enough to allow structural or optical failure in the event of harvesting, but is visually undetectable, especially in reflected light. Perforations that allow light through (i.e., at least one-half the wavelength of incident light) but can visually undetectable in at least one of reflected or transmitted light. In various embodiments, the set of perforations are preferably dimensioned such that at least one of the perforations is less than 100 microns, less than 50 microns, or less than 35 microns. A view in reflected light in the context of the present disclosure encompasses an illumination of the security document, or security device from one side and a view of the security device from the same side. Alternatively, a view in transmitted light encompasses an illumination of the security document or security device from one side and a view of the security device from an opposing side.

Perforations defining the anti-harvesting area, according to various embodiments of this disclosure, may extend at normal or oblique angles, or combinations thereof in the anti-harvesting area. In certain embodiments, it can be advantageous, from a performance perspective to have the perforations extend in an oblique angle, wherein the perforations are less visually detectable. In certain embodiments, angled perforations are used when the set of perforations are integrated in the security device. As used herein, the term "visually detectable" encompasses the property of a feature being resolvable by the unaided eye, while the term "visually undetectable" encompasses features which are unresolvable by the unaided eye. For example, in one embodiment, when the anti-harvesting area is viewed in reflected light, the set of perforations are visually undetectable. In certain embodiments, the set of perforations are not only visually undetectable but are also arranged relative the optically variable feature such that they do not substantially interrupt the fidelity of the optically variable feature in the anti-harvesting area with that of the optically variable feature in the bulk area. Oblique perforations are, in some embodiments, preferable since they reduce detection not only in reflected light but also in transmitted light where detection requires that the anti-harvesting area be viewed from the oblique angle of the perforations in order to be detected. Angles referenced herein are made in reference to a plane parallel to the upper surface of the security device.

The set of perforations may, in various embodiments according to this disclosure, be distributed in the anti-harvesting area in any predetermined pattern. For example, it is contemplated that the perforations are, in some embodiments, arranged into a set of indicia which may function as a further element of authentication for the security document. More specifically, the set of perforations may be arranged to form letters, numbers, or symbols. For example, in an embodiment where the security document is a banknote, the set of perforations are arranged in the form of a number reflecting the denomination of the banknote. Additionally, it is also contemplated that, in some embodiments, the set of perforations extend through a single component of the security document or through multiple components or only through a portion of the depth of a single component, or through a portion of the depth of multiple components, or any combination thereof. For example, in at least one embodiment, the perforations extend only through a portion (i of the depth of the security device. In certain embodiments, the set of perforations in the anti-harvesting area extend through the entire thickness of the security device and through the entire thickness of the security substrate. In certain embodiments, which have been shown to exhibit excellent anti-harvesting resistance, the set of perforations in the anti-harvesting area includes perforations that extend through at least 85% of the full depth of the security device, with depths of at least 90%, 95%, 96%, 97%, 98% 99% or 100% of the depth/thickness of the security device.

In at least one embodiment, where the security device is a micro-optic security device comprising at least an array of focusing elements and an array of micro-image elements, it is contemplated that the set of perforations are sized or arranged to provide an visually detectable indicia of authenticity. For example, in certain embodiments, the set of perforations extend through the entire depth of the focusing elements, serving to ablate or remove these focusing elements, but not the underlying micro-image elements or other components forming parts of the security device. For example, in at least one embodiment, the set of perforations includes at least one perforation that has at least one lateral dimension that is greater than 100 microns, greater than 125 microns or greater than 135 microns, and which comprises an overt feature. Here, the set of perforations renders the security device, in the anti-harvesting area, incapable of projecting a synthetic image (e.g., the optically variable feature). In certain embodiments, the perforations can be characterized as ablations and may be combined or arranged in the form of various indicia, such as an image, a string of characters, an encoding or pattern. While not required, in various embodiments, the ablated regions are coordinated with one or more synthetic images in the anti-harvesting area or in the bulk area. In at least one embodiment, the ablated regions, while larger than the perforations described above, are still small enough such that they are visually undetectable individually in reflected light, but would be visually detectable in transmitted light. According to various embodiments, when the security device is viewed in reflected light, the ablated regions, in this embodiment, are visually detectable both individually as well as in combination.

It is also contemplated herein that, in certain embodiments according to this disclosure, the ablated regions are combined with other artifacts of the security document. For example, in at least one embodiment, the ablations forming the anti-harvesting area are layered with an ink layer or effect layer disposed on the security substrate.

The set of perforations may extend through a minor or a major portion of the depth of the security document or any component of the security document or combination thereof. As used herein, the term "major portion" encompasses a depth of thickness that is greater than 50% (including up to 100% of thickness) of the thickness of the referenced security document or security document component. Conversely, it should be understood in the context of the present disclosure that the term "minor portion" encompasses a depth of thickness that is less than or equal to 50% of the thickness of the referenced security document or security document component. For example, the set of perforations may extend through a major or minor portion of the security device, or a major or minor portion of the substrate, or a major or minor portion of the combined thickness of the security device, the security substrate and any other interleaved (e.g., an adhesive between a security substrate and a security device) or otherwise coupled security document component. Such partial depth perforations have, in certain embodiments according to this disclosure, been found to perform well in disguising the anti-harvesting areas since even in transmitted light the perforations may still not be visually detectable. Such partial depth perforation can also be approximated by having the perforations taper from one side of the security document, security substrate, or security device toward the opposing side; particularly from the side of the security device where the anti-counterfeit feature would be observed. Moreover, such embodiments may be especially suitable for manufacturability since implementing manufacturing controls necessary for terminating the perforations within the depth/thickness of the security device or security substrate, as the case may be, may not be required.

As noted, the set of perforations may, in some embodiments, be dimensionally uniform or variable in their dimensions (for example, inner circumference, diameter, taper, depth, etc.), across the anti-harvesting area. Additionally, the distribution of the set of perforations, size, shape (e.g., lines, circular, trapezoidal, triangle, star, rhomboid, oval, etc.) may, in some embodiments be uniform or variable across an anti-harvesting area. In at least one embodiment, all of the perforations within each of the anti-harvesting areas are uniform across those areas but distinct among the various anti-harvesting areas in the security device such that a first anti-harvesting area may have a first set of perforations and a second anti-harvesting area has a second set of perforation that are different in terms of shape, size, depth, or distribution.

It should be understood, that a security document, may have multiple security devices and that security devices may have multiple anti-harvesting areas and reference herein to a single anti-harvesting area of single security device should be understood as encompassing multiples of the same.

While the anti-harvesting area is, in various embodiments according to this disclosure, confined within the boundaries of the security device, it is also contemplated herein that the set of perforations defining the anti-harvesting area may also extend beyond the edges of the security device. For example, in certain embodiments, the set of perforations forming the anti-harvesting area is complemented by a set of perforations which extend beyond the anti-harvesting area over portions of the security substrate not overlapped by the security device. It is also contemplated that, in some embodiments, the perforations randomly extend beyond the boundaries of the security device. It is also contemplated herein that the perforations are equipped with a tactile or haptic feature which is easily detectable for a user or by a machine. Alternatively, in one embodiment, the arrangement of set of perforations may be arranged with a predefined frequency such that it provides an authenticating tactile feature.

The set of perforations can according to various embodiments the present disclosure can be configured in a wide variety of ways. In certain embodiments according to this disclosure, effective perforations are formed in the security document component of choice after the security device has been coupled to the security substrate. Moreover, it has been found most suitable to use laser irradiation to form the set of perforations in the security device, the security substrate or any of the other security document components. For example, in one embodiment, the perforations are produced using an infrared laser, such as a $CO_2$ laser. Particularly, where it is desired that the perforations are tapered, the use of a laser for formation of the perforations is suitable. Ablations as described herein are also formed in exemplary embodiments by the use of a laser, such as a $CO_2$ laser.

In certain embodiments, lasers, especially high-frequency excited, fast modulating $CO_2$ lasers have been shown to provide excellent power stability and control, and are suitable for constructing security documents according to embodiments of this disclosure, in particular, embodiments using tapered perforations. According to some embodiments, laser-formed perforations, the size of the perforations' diameters range from about 50 to about 400 microns at its widest opening and can be achieved at perforating speeds of up to, for example, 420,000 holes per second.

Security Document

Various alternative uses of the security documents will become apparent to persons having ordinary skills in the art, in hindsight of the present disclosure. For example, security documents contemplated within the scope of the present disclosure include, without limitation, security documents such as identification documents (e.g., passports, government IDs, etc.), currency documents (e.g., checks, banknotes, etc.) or consumer product documents (e.g., labels, signs, tags, etc.).

In at least one embodiment, the security document comprises a security device that is a micro-optic security device that comprises an array of micro-sized image elements (i.e., image icons) located on or within a polymeric substrate, and an arrangement of focusing elements. The image elements and focusing elements arrangements may be separated by an optical spacer. In either case, the image icon and focusing elements arrangements are configured such that when the arrangement of image icons is viewed through the arrangement of focusing elements, one or more synthetic images (i.e., an optically variable feature) are projected. In this embodiment, the micro-optic security device is applied to an upper surface of a security substrate, the one or more perforations extending through the entire thickness of both the micro-optic security device and the underlying security substrate. A lower surface of the security substrate/document may be provided with a simple ink layer or an effect layer (e.g., a layer containing luminescent or optically variable particles), provided such a layer does not interfere with the optical effect generated by the security device. The effect layer may serve as a public or machine detectable and optionally machine readable security feature.

Method of Making a Security Document

In another aspect of the present disclosure, a method of making a security document is provided. In certain embodiments according to this disclosure, the method comprises supplying a security device coupled to a security substrate and integrating a structural weakness element with at least one of the security device and the security substrate. The structural weakness element is, in certain embodiments, integrated such that an anti-harvesting area and a bulk area are defined in the security device. The anti-harvesting area is configured to cause the security device or the security substrate to suffer at least one of structural failure or optical failure.

In certain embodiments, a method is provided for increasing or improving the harvesting resistance of a security document or security device, wherein the method comprises applying one or more structural weakness elements to at least one of a security substrate or a security device. The structural weakness element is configured to induce optical or structural failure upon a harvesting attempt.

According to various embodiments, a laser is used to create perforations after a security device (e.g., a security thread or patch) is applied to a security substrate, either on the paper machine, or in an earlier stage of the foiling process using an offline stripe or patch application system such as those sold by LEONHARD KURZ Stiftung & Co. KG and Pasaban SA. In various embodiments, by perforating, ablating or cutting the security device or the security paper with a laser once the device has been attached to the paper, at least one of the optical fidelity or structural fidelity needed for the application of the device to the paper can be maintained. After the anti-harvesting areas have been added, the security device or security substrate will suffer optical or structural failure in response to a harvesting attempt thereby preventing the device's removal in a single, reusable piece.

Structural/Optical Fidelity

Optical fidelity, as used herein, encompasses a similarity of the optically variable effect observed in the anti-harvesting area and that observed in the bulk area of the security device. As used throughout herein, the term "structural fidelity" encompasses an alignment of the anti-harvesting area of the security device to the bulk area of the security device or the substrate. Structural fidelity is, in some embodiments, indicated by substantial alignment of the anti-harvesting area of the security device to the bulk area of the security device or substrate. Substantial alignment, as used in this disclosure, encompasses, at a minimum, (i) where the anti-harvesting area of the security device has a width ranging from about 75% of the bulk area width of the security device to about 125% of the bulk area width; more preferably about 80% to about 120%; more preferably about 90% to about 110% or (ii) where perforations in the security device's anti-harvesting area extend beyond a boundary of the security device such that the shape of the perforations in the anti-harvesting area are identical to the shape of the perforations extending into the substrate or are fully in the substrate. For example, in at least one embodiment, the anti-harvesting area of the security device has structural fidelity with the bulk area of the security document, such that the edge of the security device traversing the anti-harvesting area is substantially aligned with the immediately connected bulk area of the security device such that there is no structural failure (i.e., tapering of the anti-harvesting area from the bulk area). In at least one embodiment, the structural fidelity is demonstrated by perforations which extend beyond the boundaries of the security device where the shape of the perforations in the anti-harvesting area are identical in shape and size to those in the bulk area or in areas of the substrate adjacent to the anti-harvesting area.

In various embodiments according to this disclosure, the anti-harvesting area of the security device has optical fidelity with adjacent bulk area, such that the optically variable feature present in the anti-harvesting area is also present in the bulk area without visually observable distortion. As used in this disclosure, the term "observable distortion" encompasses a change in at least one of image effect, shape, size, color, or clarity. The fidelity, optical or structural, is, in various embodiments, secured by integrating the structural weakness element (for example, a set of perforations) with the security device after the security device has been coupled (for example, securely attached directly to the security substrate). By integrating the structural weakness element after the security device is coupled to the security substrate, the process step of adjusting the tension of the security device when the perforations are already formed in the security device—which can cause uneven deformation of the security device such that more deformation and irreversible deformation occurs in the anti-harvesting area compared to the bulk area—is avoided.

Certain embodiments according to this disclosure comprise a method for using one or more structural weaknesses applied to a security device or security document to induce failure within the security device causing the device to fail when any attempt is made to harvest the security device from the security document.

EXAMPLES

The invention will now be illustrated by reference to a security document in the form of a banknote. In the illustrative example shown in FIG. 1A, a security document 10 (for example, a banknote) 10 is provided, the security document comprising a micro-optic film material (i.e., the security device) 14 that is coupled to a security substrate 16. Referring to the non-limiting example of FIG. 1A, harvesting resistance is provided by way of a set of perforations 12 defining an anti-harvesting area 17 and a bulk area 19, wherein the set of perforations 12 extend at a normal angle relative to a surface 14*a* of a micro-optic security device 14 According to various embodiments, the perforations of set of perforations 12 extend through both micro-optic security device 14 and security substrate 16. In this illustrative example, micro-optic security device 14 comprises an array of non-cylindrical microlenses 14*b* disposed over an array of image elements 14*c*. In various embodiments according to this disclosure, an optical spacer 14*d* is disposed between the array of microlenses 14*b* and the array of image elements 14*c* such that the security device 14 projects one or more synthetic images (not shown).

Figure 1B:
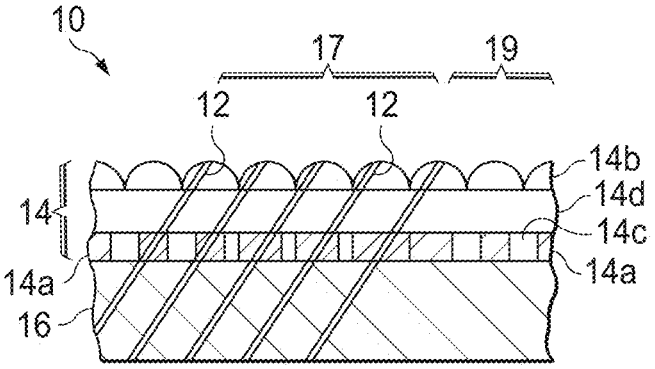
FIG. 1B illustrates an example of a security document according to some embodiments of this disclosure wherein the set of perforations extend at an oblique angle instead of a normal angle.

FIG. 1B illustrates an example of a security document according to some embodiments of this disclosure. Referring to the non-limiting example of FIG. 1B, a variation of the exemplary embodiment described in FIG. 1A is shown with the set of perforations 12 extending at an oblique angle instead of at a normal angle. In the non-limiting example of FIG. 1B, security document 10 comprises a micro-optic film 14, in the form of a stripe that is coupled to the security substrate 16 before perforations 12 are applied thereby providing structural fidelity between the anti-harvesting area 17 of the security device and the bulk area of the security device 19.

As previously noted, when the security device is viewed in reflected light, the perforations 12 would be visually undetectable, but when viewed in transmitted light, at the same angle at which the perforations extend, the perforations would be visually detectable. According to certain embodiments, the on-off quality of the visibility of perforations 12 is especially pronounced when the perforations extend at an oblique angle. According to some embodiments, anti-harvesting area 17 of the micro-optic security device 14 has optical and structural fidelity with the bulk area 19 of the security device.

Figure 2:
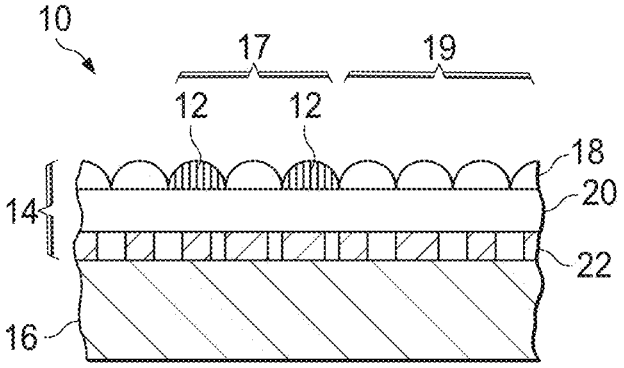
FIG. 2 illustrates an example of a security document according to some embodiments of this disclosure wherein the set of perforations and serve to ablate two focusing elements, but not the underlying optical spacer and image icons.

FIG. 2 illustrates an example of a security document according to certain embodiments of this disclosure, wherein the perforations 12 are much wider and extend entirely through focusing microlenses 18, serving to ablate or remove these focusing elements 18, without ablating or perforating the underlying components of security document 10, such as optical spacer 20 and image icons 22. According to certain embodiments, perforations 12 are formed such that they do not affect the ability of micro-optic security device 14 to projecting synthetic images in those areas. The set of perforations 12 are configured such that, in combination with microlenses 18, they provide further authentication in the form of visually detectable indicia. According to various embodiments, when the micro-optic security device 14 is viewed in reflected light, the ablated regions may or may not be visually detectable. When viewed in transmitted light, the ablated regions would be visually detectable. Importantly, the anti-harvesting area 17 of micro-optic security device 14 has optical and structural fidelity with the bulk area 19 of the security device.

Figure 3A:
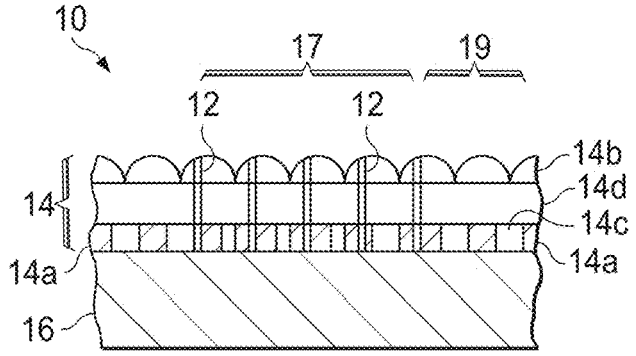
FIG. 3A illustrates an example of a security document according to some embodiments of this disclosure in which a set of perforations extend at a normal angle through the entire thickness of only the micro-optic security device.

FIG. 3A illustrates an example of a security document 10 according to some embodiments of this disclosure, in which the set of perforations extends at an oblique angle. Referring to the non-limiting example of FIG. 3A, an alternative embodiment of security document 10 in FIG. 1A is depicted. According to certain embodiments, perforations of set of perforations 12 extend at a normal angle, but only through the thickness of the micro-optic security device 14 without impacting the underlying banknote components.

Figure 3B:
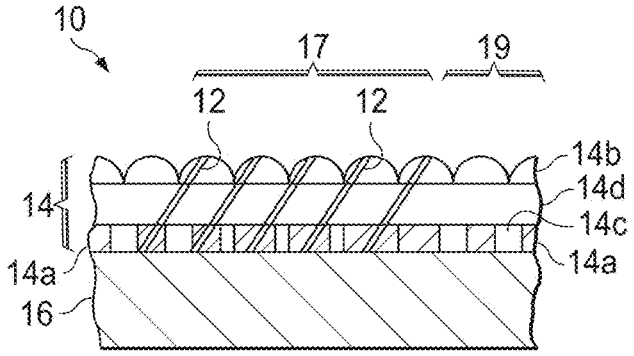
FIG. 3B illustrates an example of a security document according to some embodiments of this disclosure in which the set of perforations extend at an oblique angle instead of a normal angle.

FIG. 3B illustrates a further example of a security document 10, according to various embodiments of this disclosure. Referring to the non-limiting example of FIG. 3B, a variation of security document 10 is shown wherein perforations of set of perforations 12 extend at an oblique angle through the device 14, but not the underlying components of security document 10. According to certain embodiments, with accurate control of laser intensity and focus, it is possible to only perforate or cut through the security device 14, and not the underlying components 16 of security document 10. Similarly, accurate control of laser intensity and focus can prevent unwanted cutting into deeper layers when cutting from the opposite side. According to various embodiments, when micro-optic security device 14 is viewed in reflected light, perforations of set of perforations 12 would be visually undetectable, but when viewed in transmitted light, at the same angle at which perforations of set of perforations 12 extend, the perforations would be visually detectable. Importantly, the anti-harvesting area of the security device has optical and structural fidelity with the bulk area of the security device.

Figure 4A:
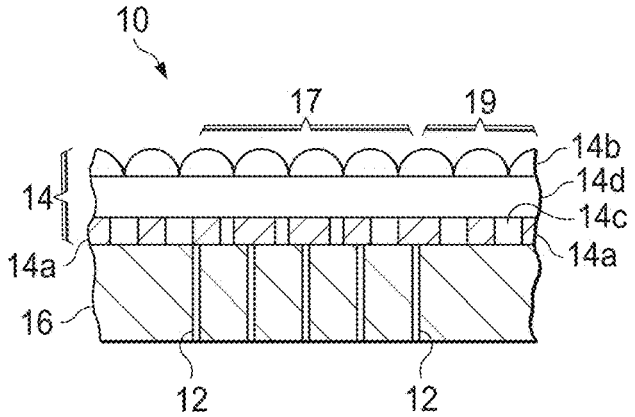
FIG. 4A illustrates an example of a security document according to some embodiments of this disclosure in which the set of perforations extend at a normal angle through the entire thickness of only the underlying security document.

FIG. 4A illustrates an example of a security document 10 according to some embodiments of this disclosure, in which perforations of a set of perforations 12 extend at a normal angle through the entire thickness of only underlying components 16 of security document 10. Referring to the non-limiting example of FIG. 4A, perforations of set of perforations 12 extend at a normal angle only through the thickness of the underlying components 16 (for example, a fibrous or polymer security substrate) of security device 10.

Figure 4B:
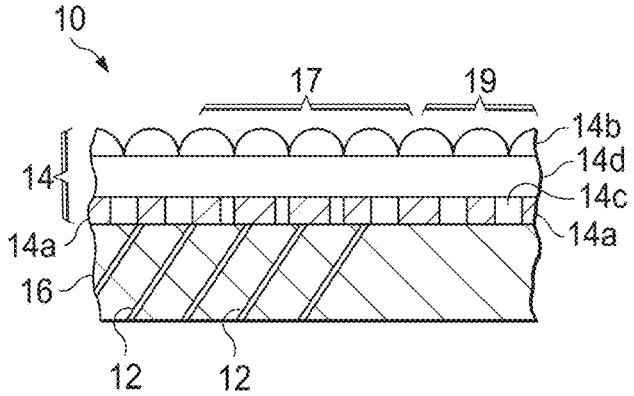
FIG. 4B illustrates an example of a security document according to some embodiments of this disclosure in which the set of perforations extend at an oblique angle instead of a normal angle.

FIG. 4B illustrates an example of a security document 10 according to various embodiments of this disclosure. Referring to the non-limiting example of FIG. 4B, perforations of set of perforations 12 extend at an oblique angle through the underlying structures 16 of security document 10. In some embodiments, perforations of set of perforations 12 (for example, embodiments as shown in the examples of FIGS. 4A and 4B) are tapered such that they are wide at the interface with the micro-optic security device 14 and narrow as they travel towards the opposite side of the underlying structures 16. Importantly, anti-harvesting area 17 of the micro-optic security device 14 has optical and structural fidelity with the bulk area 19 of micro-optic security device 14.

Figure 5:
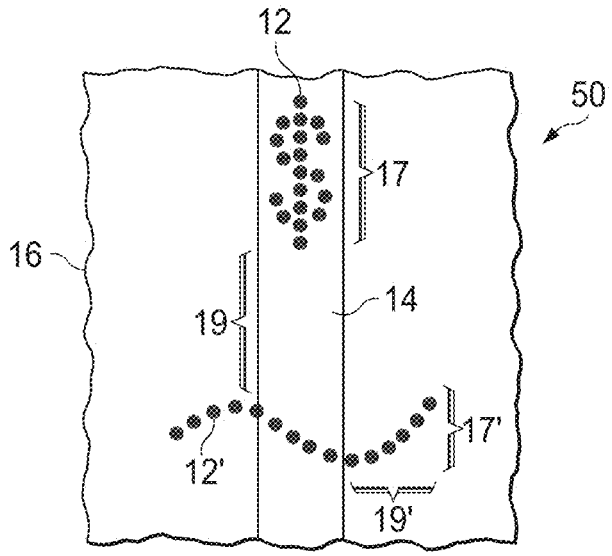
FIG. 5 illustrates an example of a security document according to some embodiments of this disclosure in which perforations are applied in a pattern, the set of perforations applied as (a) a dot matrix forming a dollar sign symbol that is contained within the confines of a security thread and (b) a non-linear line which extends across the security thread and out into the body of the security document.

FIG. 5 illustrates an example of a security document 50 according to various embodiments of this disclosure. Referring to the non-limiting example of FIG. 5, perforations of sets of perforations 12, 12' are in the form of a 'dot matrix' formed in the shape of a dollar sign symbol, which is contained within the boundaries of a security device 14, and in the form of a non-linear line which extends across the security device 14 and outside the boundary of the security device 14 into the bulk of the underlying structure 16. According to certain embodiments the dot matrix form of sets of perforations 12 and 12' adds an additional anti-counterfeit feature by having a complementary perforation pattern outside of the security device 14 that is directly correlated to set of perforations within the boundary of the security device 14. As shown in this non-limiting example security device 14 has structural fidelity between the perforations 12 in anti-harvesting area 17 of the security device and the bulk area 19 of the security device. There is also structural fidelity between the perforations 12' in anti-harvesting area 17' and the perforations 12' in the bulk area 19' of the substrate. According to certain embodiments set of perforations in the security device are visually undetectable in reflected light but are visually detectable in transmitted light, while the perforations outside anti-harvesting area (i.e., in the security substrate) are visually detectable in both reflected and transmitted light.

Figure 6:
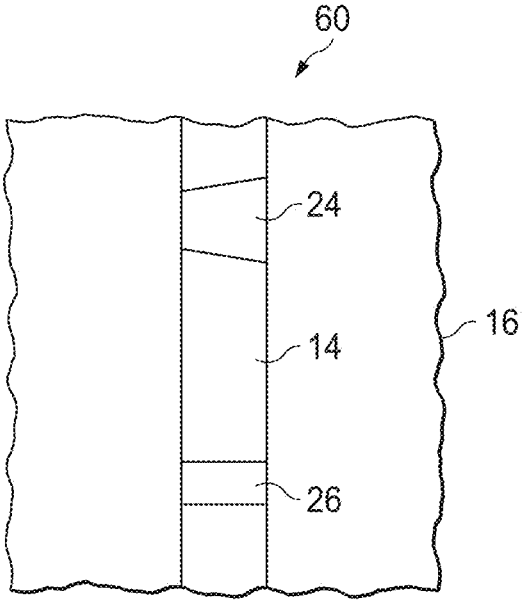
FIG. 6 illustrates an example of a security document according to some embodiments of this disclosure in which trapezoid-shaped and line-shaped perforations are used to cut the security device into what appear to be patches.

FIG. 6 illustrates an example of a security document 60 according to some embodiments of this disclosure. Referring to the non-limiting example of FIG. 6, the perforations 24, 26 in security device 10 are formed in varying shapes to enhance resistance to harvesting. Particularly, perforation 24 has a trapezoid-shaped which improves harvesting resistance as the security device will be permanently and easily deformed upon even minor attempts to harvest the security device 14, particularly where force is applied at the anti-harvesting area. A line-shaped perforation 26 is also provided in the security device, which extends through one edge of the security device through the other edge, thereby requiring a would-be harvester to remove multiple pieces of the security device in order to successfully harvest a single thread. The perforations may be in the form of a pattern selected from a group (a) dot matrix that forms complex or simple designs and (b) a simple shape in the form of one or more lines, which may be linear or non-linear. By extending across the entire width of the security device 14, it serves to cut the security device 14 into smaller pieces, such as patches. According to certain embodiments, shaped perforations, such as perforations 24 and 26 can be provided in combination with other anti-harvesting structures, such as described with reference to the examples of FIGS. 1A through 5 of this disclosure. In certain embodiments according to this disclosure, the anti-harvesting area of security device 60 has optical and structural fidelity with the bulk area of the security device.

Figure 7:
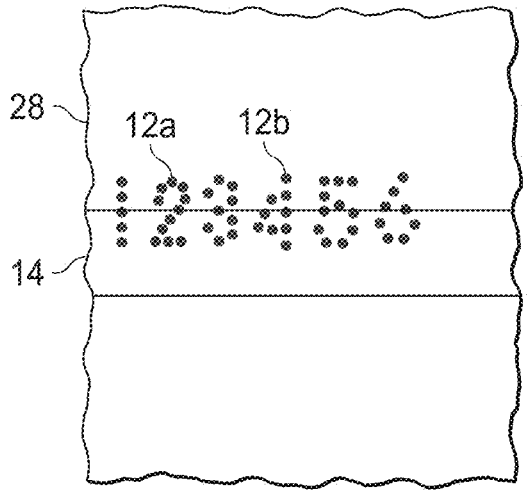
FIG. 7 illustrates an example of a security document according to some embodiments of this disclosure in which the security document is a banknote and the set of perforations are used to serialize the banknote and do so by extending across the security device and into the body of the banknote.

FIG. 7 illustrates an example of a security document (in this case, banknote 28), according to various embodiments of this disclosure. Referring to the non-limiting example of FIG. 7, perforations 12*a* and 12*b* can also be used to serialize a banknote 28. As shown in this non-limiting example, perforations 12*a* and 12*b* extend across the applied security device 14 and into the body of banknote 28. This adds not only failure points to the device 14 and banknote 28, that take effect during a harvesting attempt, but it also adds a unique pattern into the device and banknote. Importantly, the anti-harvesting area of security device 14 has optical and structural fidelity with the bulk area of the security device.

Figure 8:
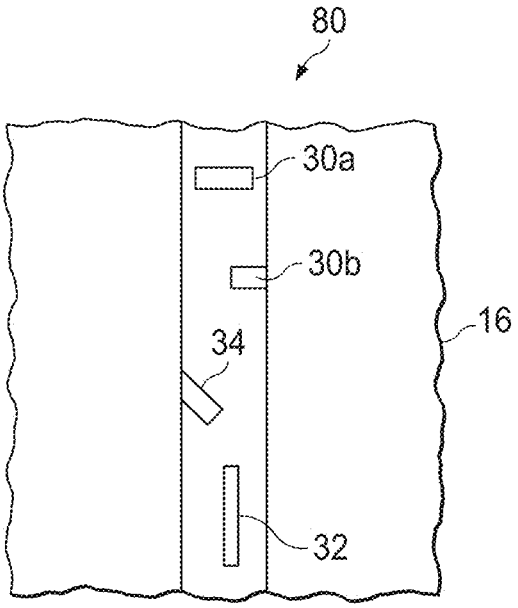
FIG. 8 illustrates an example of a security document according to some embodiments of this disclosure in which line-shaped perforations are formed in the security device, some of which extend toward and breach the edge of the attached device.

FIG. 8 illustrates an example of a security document 80 according to certain embodiments of this disclosure. Referring to the non-limiting example of FIG. 8, line shaped perforations 30*a*, 30*b*, 32 and 34 are formed in security device 14. As shown in the illustrative example of FIG. 8, perforations 30*a*, 30*b*, 32 and 34 have orientations with respect to the underlying structure 16. Some of the perforations (30*a*, 30*b*) are orientated horizontally (i.e., along a first axis x), while perforation 32 is orientated vertically (i.e., along a second axis y), while perforation 34 is acutely angled relative to the first axis. Some of the perforations (30*a*, 32) are contained within the confines of the device while others (30*b*, 34) extend to and breach the edges of the device. According to certain embodiments, by skewing the orientation of perforations and positioning them at different locations relative to security device 14, the likelihood of tear propagation if one were to try to remove the device can be increased, and the visual impact and visibility of the applied feature can be enhanced by increasing the complexity of its shape or pattern. Importantly, the anti-harvesting area of the security device 14 has optical and structural fidelity with the bulk area of the security device.

Examples of a security document according to various embodiments of this disclosure include a security document having a security substrate, a security device and a structural weakness element, wherein the security device is coupled to the security substrate, wherein the structural weakness element is integrated with at least one of the security substrate or the security device, the structural weakness element defining an anti-harvesting area and a bulk area, and wherein the anti-harvesting area has one or more of structural fidelity or optical fidelity with the bulk area.

Examples of security documents according to various embodiments of this disclosure include security documents, wherein the security device is a micro-optic security device comprising an array of image elements, and wherein the structural weakness element comprises a part of the array of image elements.

Examples of security documents according to various embodiments of this disclosure include security documents wherein the structural weakness element includes a set of perforations.

Examples of security documents according to various embodiments of this disclosure include security documents wherein the set of perforations comprise perforations which extend at either a normal or oblique angle relative to a plane parallel to a top surface of the security device.

Examples of security documents according to various embodiments of this disclosure include security documents wherein the set of perforations extend through at least a portion of a depth of the security device or the security substrate.

Examples of security documents according to various embodiments of this disclosure include security documents wherein the security device is a micro-optic security device comprising an array of micro-sized image elements located on or within a polymeric substrate, and an array of focusing elements, and wherein the array of micro-sized image elements and the array of focusing elements are configured such that when the array of micro-sized image elements is viewed through the array of focusing elements, one or more synthetic images are projected.

Examples of security documents according to various embodiments of this disclosure include security documents wherein the set of perforations extend fully through the security device, or extend through a subset of focusing elements and ablate focusing elements of the subset of focusing elements, rendering the security device incapable of projecting synthetic images in those areas.

Examples of security documents according to various embodiments of this disclosure include security documents wherein the set of perforations extend through a major portion of the security substrate.

Examples of security documents according to various embodiments of this disclosure include security documents wherein all perforations in the anti-harvesting area have substantially a same shape and same lateral dimensions parallel to a surface of the security document and same axial dimensions perpendicular to a surface of the security substrate.

Examples of security documents according to various embodiments of this disclosure include security documents wherein perforations of each anti-harvesting area have different shapes or different lateral dimensions parallel to a surface of the security substrate or different axial dimensions perpendicular to a surface of the security substrate.

Examples of security documents according to various embodiments of this disclosure include security documents wherein the set of perforations is located wholly within the security device.

Examples of security documents according to various embodiments of this disclosure include security documents wherein the set of perforations extends beyond boundaries of the security device.

Examples of security documents according to various embodiments of this disclosure include security documents wherein the security document is a banknote.

Examples of security documents according to various embodiments of this disclosure include security documents wherein the security document is a banknote, and the set of perforations comprises a serial number for the banknote, and extends across both the anti-harvesting area of the security device and the boundaries of the security device.

Examples of security documents according to various embodiments of this disclosure include security documents wherein the set of perforations forms a visible pattern.

Examples of security documents according to various embodiments of this disclosure include security documents wherein the set of perforations comprises one or more of line-shaped perforations or polygon-shaped perforations.

Examples of security documents according to various embodiments of this disclosure include security documents wherein the set of perforations forming the anti-harvesting area extends fully across a width of the security device, cutting the security device into smaller pieces.

While various embodiments of the present disclosure have been described above, it should be understood that they have been presented by way of example only, and not limitation. Thus, the breadth and scope of the present disclosure should not be limited by any of the exemplary embodiments.

Although the present disclosure has been described with various embodiments, various changes and modifications may be suggested to one skilled in the art. It is intended that the present disclosure encompass such changes and modifications as falling within the scope of the claims.

The present disclosure should not be read as implying that any particular element, step, or function is an essential element, step, or function that must be included in the scope of the claims. Moreover, the claims are not intended to invoke 35 U.S.C. § 112(f) unless the exact words "means for" are followed by a participle.

What is claimed is:

1. A security document, comprising:

a security substrate;

a security device, wherein the security device comprises an array of image icons, an optical spacer and an array of focusing elements, wherein the array of focusing elements projects a synthetically magnified image of image elements within the array of image icons, wherein the array of focusing elements is disposed on the optical spacer and comprises a polymeric material; and a structural weakness element, wherein the security device is coupled to the security substrate, wherein the structural weakness element comprises a set of perforations extending through the array of focusing elements, wherein the structural weakness element is not visible in reflected light; and wherein the structural weakness element does not affect the synthetically magnified image of image elements projected by the array of focusing elements.

2. The security document of claim 1, wherein the security device is a micro-optic security device.

3. The security document of claim 1, wherein the set of perforations comprises perforations which extend at either a normal or oblique angle relative to a plane parallel to a top surface of the security device.

4. The security document of claim 1, wherein the set of perforations extends through at least a portion of a depth of the optical spacer.

5. The security document of claim 1, wherein the set of perforations:

extends fully through the security device.

6. The security document of claim 1, wherein the set of perforations extends through a major portion of the security substrate.

7. The security document of claim 1, wherein all perforations of the set of perforations have substantially a same shape and same lateral dimensions parallel to a surface of the security document and same axial dimensions perpendicular to a surface of the security substrate.

8. The security document of claim 1, wherein perforations of the set of perforations have different shapes or different lateral dimensions parallel to a surface of the security substrate or different axial dimensions perpendicular to a surface of the security substrate.

9. The security document of claim 1, wherein the set of perforations is located wholly within the security device.

10. The security document of claim 1, wherein the set of perforations extends beyond boundaries of the security device.

11. The security document of claim 1, wherein the security document is a banknote.

12. The security document of claim 1, wherein the security document is a banknote, and the set of perforations comprises a serial number for the banknote, and extends across boundaries of the security device.

13. The security document of claim 1, wherein the set of perforations forms a pattern visible in transmitted light.

14. The security document of claim 1, wherein the set of perforations comprises one or more of line-shaped perforations or polygon-shaped perforations.

15. The security document of claim 1, wherein the set of perforations extends fully across a width of the security device, cutting the security device into smaller pieces.

16. A method for making a security document, comprising:

providing a security device coupled to a security substrate, wherein the security device comprises an array of image icons, an optical spacer and an array of focusing elements, wherein the array of focusing elements projects a synthetically magnified image of image elements within the array of image icons, wherein the array of focusing elements is disposed on the optical spacer and comprises a polymeric material; and integrating a structural weakness element into the security device, wherein the structural weakness element comprises a set of perforations extending through the array of focusing elements, wherein the security device is coupled to the security substrate before integration of the structural weakness element, wherein the structural weakness element is not visible in reflected light, and wherein the structural weakness element does not affect the synthetically magnified image of image elements projected by the array of focusing elements.

17. A security document made in accordance with the method of claim 16.

* * * * *